US005819746A

United States Patent [19]

Walton

[11] Patent Number: 5,819,746

[45] Date of Patent: Oct. 13, 1998

[54] REMOVABLE SPINAL BOARD PADDING

[76] Inventor: Ross T. Walton, 2795 O Rd., Cedaredge, Colo. 81413

[21] Appl. No.: 546,887

[22] Filed: Oct. 23, 1995

[51] Int. Cl.[6] ..... A61B 19/00

[52] U.S. Cl. ..... 128/869; 128/870; 5/625

[58] Field of Search ..... 128/845, 846, 128/869, 870; 602/32, 33; 5/625, 638

[56] References Cited

U.S. PATENT DOCUMENTS

| | | | |
|---|---|---|---|
| 30,588 | 11/1860 | Pitts | 602/33 |
| 2,517,443 | 8/1950 | Rhodes | 5/625 |
| 5,088,137 | 2/1992 | Rose | 5/625 |
| 5,481,770 | 1/1996 | Ahlsten | 5/625 |

*Primary Examiner*—Michael A. Brown
*Attorney, Agent, or Firm*—Michael D. Carbo

[57] ABSTRACT

The following invention describes padding for a long spinal board. The padding consists of a polyurethane or polyvinyl chloride foam core that has a waterproof covering. The shape of the pad allows it to fit onto any adult size long spinal board currently on the market. Additional padding at one end of the board elevates the head of the patient to an anatomically neutral position. Slots within the padding running longitudinally and transversely permit straps to slide freely inside the padding. These straps secure the pad to the board and the patient to the pad.

11 Claims, 6 Drawing Sheets

REMOVABLE SPINAL BOARD PADDING

BACKGROUND

This invention has its use in the immobilization of victims of trauma suspected of having possible spinal cord injuries. Presently either wooden boards or metal baskets transport these victims from the scene of injury to a hospital. Sandbags and tape immobilize the patient's head and neck to the board, the application of which is time consuming. Often these patients must remain secured to the device for several hours. Multiple studies have demonstrated that these devices are extremely uncomfortable and can cause decubitus ucler formation in certain high risk individuals such as those paralyzed as a result of their injuries. Furthermore placing patients flat on these boards results in the neck resting in a position of anatomical hyperextension. A recent study had demonstrated that the addition of padding to these boards improves patient comfort and may decrease the likelihood of decubitus ulcer formation without compromising spinal immobilization. Other research has shown that additional padding to support the head places the spine in an anatomically neutral position and may therefore decrease the risk of cervical spine injury.

Conventional spinal pads have numerous shortcomings. Many are of excessive width that precludes the transporter from placing his or her hand inside the handholds on the sides of the underlying backboard. Some of the boards have removable straps that are easily lost. Still others have straps fixed to the padding. Some pads secure to spinal boards with straps that cross beneath the board, preventing the user from being able to slide the board when necessary. These pads do not allow the straps to move so that they can slide through handholds that are at varying locations on the spinal boards. Some spinal pads are incorporated into the construction of the underlying board. These function well but are prohibitively expensive to many ambulance companies, who could benefit from a pad that adapts to the spinal boards they already have in use. None of the pads currently in use have a built-in head pad to place neck in an anatomically neutral position. Finally none of the pads incorporate a means of securing the patient's head to the padding, which is crucial in adequately immobilizing the cervical spine. A spinal pad is needed that avoids these disadvantages.

SUMMARY

The present invention alleviates the above mentioned disadvantages inherent in presently used spinal pads. The apparatus consists of a foam core made of either polyurethane or polyvinyl chloride. The pad cover is a material that is waterproof and washable such as polyvinyl chloride.

The dimensions of a pad according to the invention are such that it is adequately narrow to allow handholds on conventional adult spinal boards to be fully exposed. The end of the pad that will accommodate the head tapers when viewed from above to allow the pad's use on boards that have similar tapering.

When viewed from the side, a pad according to the invention has slits (also covered with polyvinyl chloride) that have straps running through them. These slits extend from one side of the pad to the other. When viewed from end there is a similar slit that extends the entire length of the pad. This slit also houses a strap. These slits are wide enough to allow the straps to slide horizontally or transversely such that the straps pass through handholds of a conventional spinal board. The ability to move these straps will allows their placement to accommodate variations in patient body habitus. These transverse and longitudinal slits rest apart from each other by a portion of the foam core such that the straps do not become entangled within themselves.

The straps are X-shaped when viewed from the end. The upper half of the X is adapted to encircle and secure a patient to the pad. The lower half of the X-shaped strap apparatus passes through the spinal board. It then ascends to adjustably fasten to the other limb of strap to secure the pad to the board. This manner of attaching the pad to the board will allow runners found on the bottom of many spinal boards to slide when desired. The stays are detachable so that the straps can be removed and washed when desired.

The straps have at their free ends adjustable fasteners or Velcro. This provides for adjustable length of the straps to conform to variations in size and shape of both the spinal board and the patient.

A Y-shaped strap when viewed from above at the level of the patient's head immobilizes the neck. Respective arms of the Y will encircle the chin and forehead. This obviates the need for conventionally used tape that is time-consuming to apply, non-reusable, and uncomfortable when removed.

DRAWINGS

The above features and advantages of this invention are illustrated in the following drawings where:

DESCRIPTION

Figure 1:
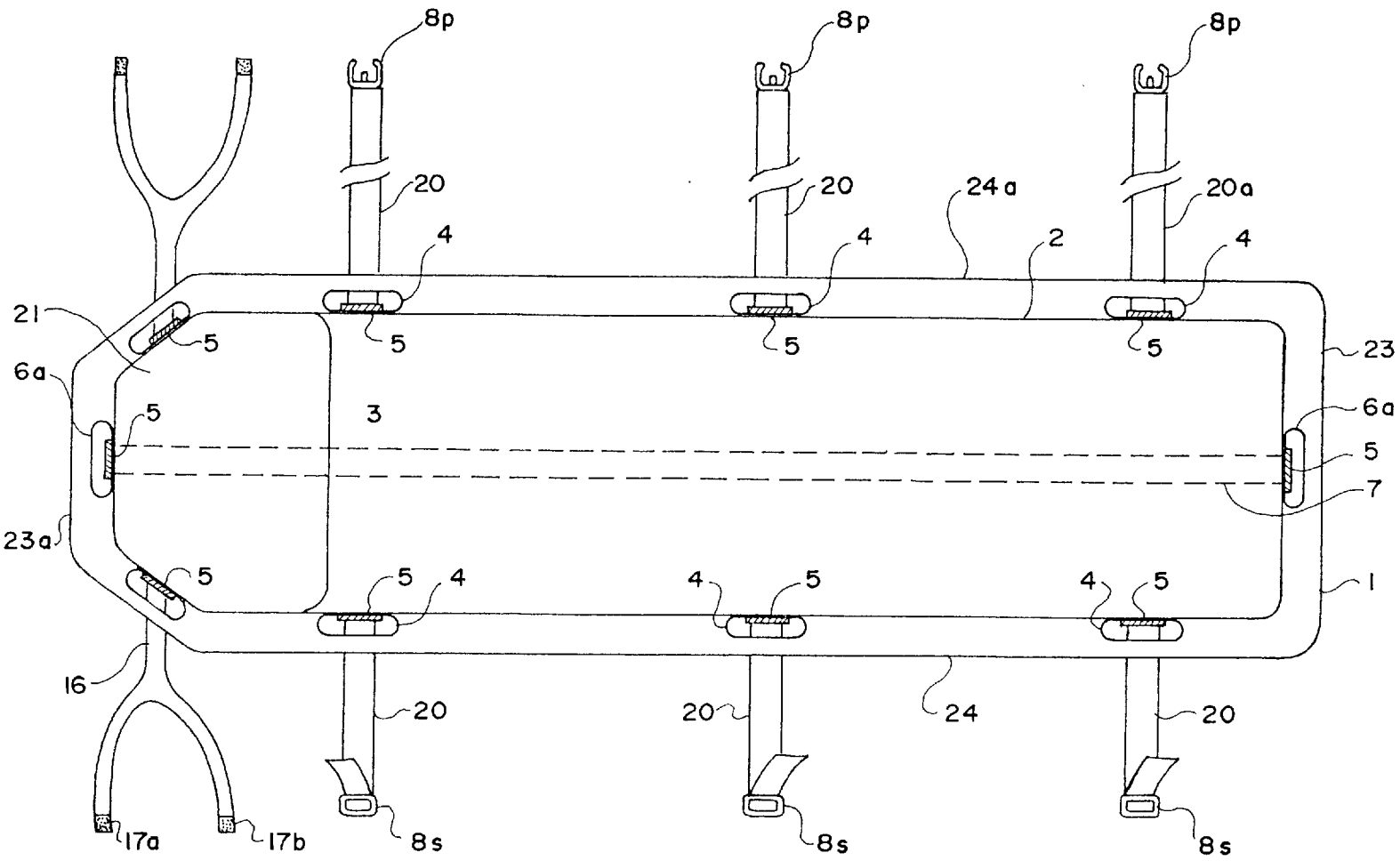
FIG. 1 is a top plan view of an embodiment of spinal board pad according to the invention showing the pad resting on top of a long spinal board.
Figure 2:
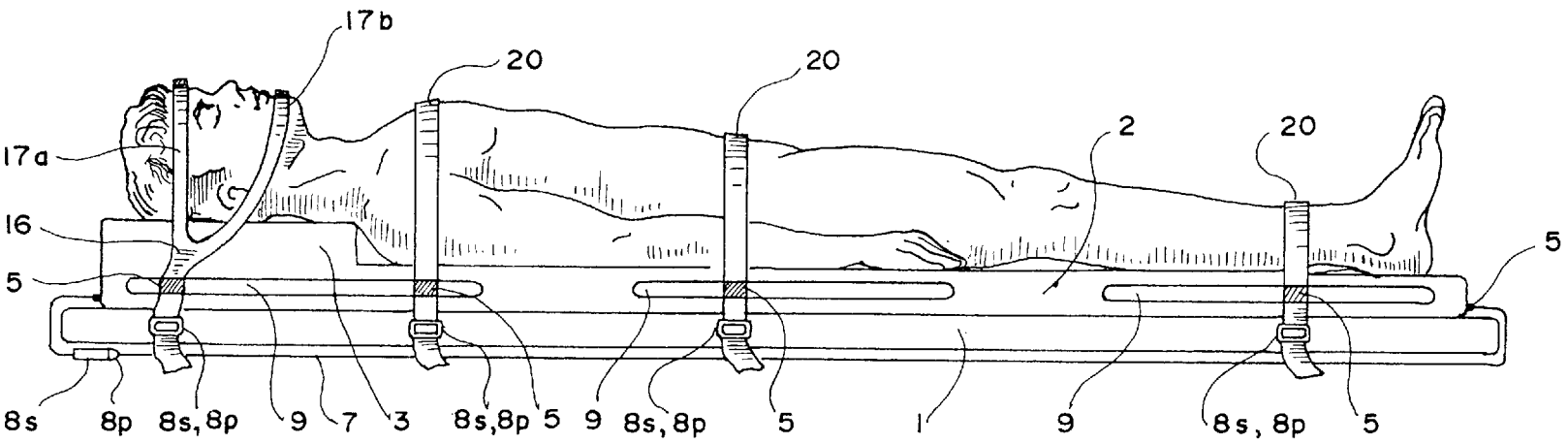
FIG. 2 is a side view of the spinal board pad shown in FIG. 1, showing the spinal board pad on top of a long spinal board.

The above invention improves patient care with respect to trauma victims (also called a "patient") suspected of having cervical spine injuries. As shown in FIG. 1 of the drawings, pad 2 has edges within the inner limits of the handholds 4 and 6 on sides 24 and 24*a* and ends 23 and 23*a*, respectively, of long spinal board 1. The end of pad 2 that accommodates a patient's head tapers when viewed from the top 21 as to follow the contour of many spinal boards with similar tapering. Headpad 3 follows this same contour. FIGS. 1 and 2 depict the limited length of headpad 3 from the top of the head footward. Headpad 3 will thus not encroach upon the neck where a cervical immobilization collar would be worn by a patient.

Figure 5:
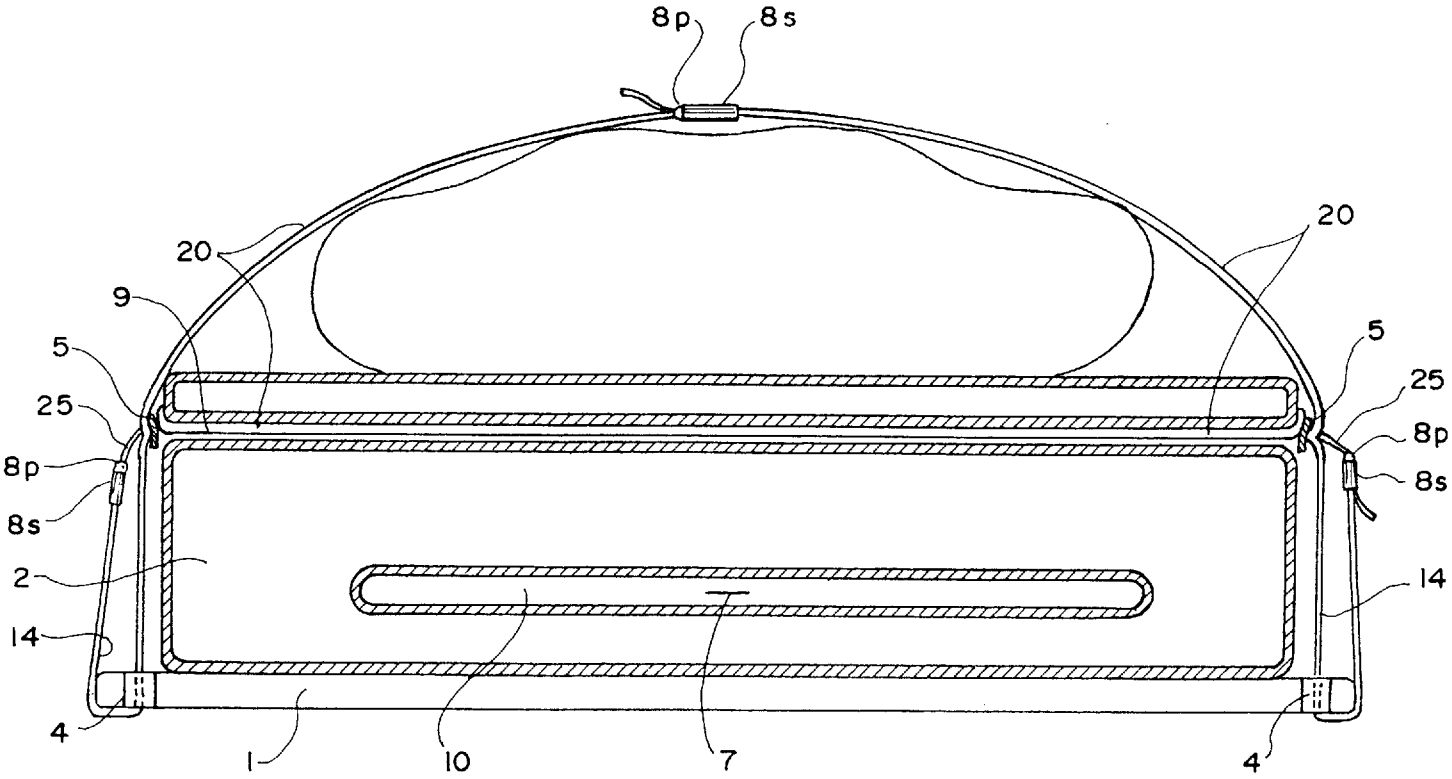
FIG. 5 is a transverse sectional view of the spinal board pad of FIG. 1, showing the spinal board pad on top of a spinal board.
Figure 6:
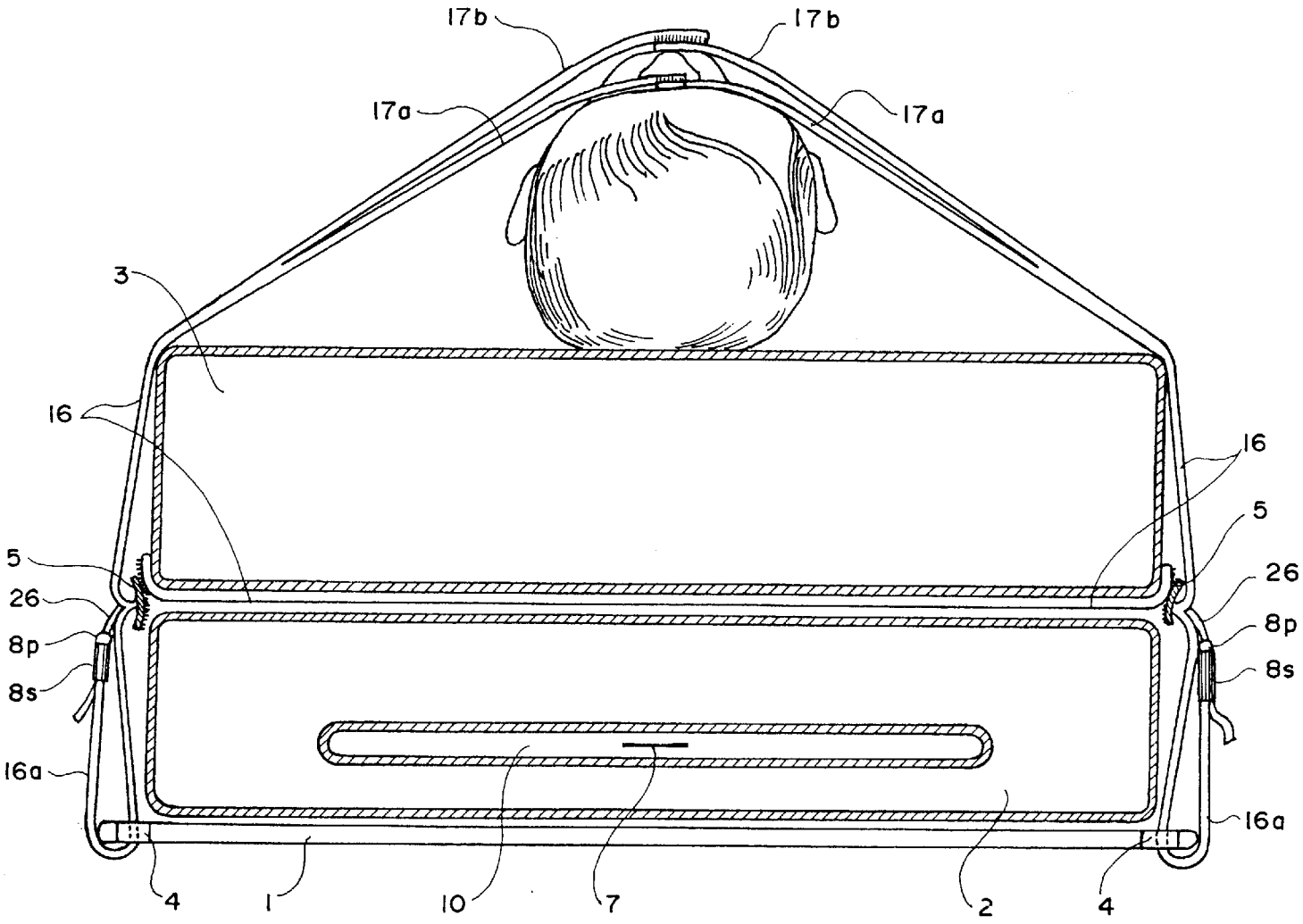
FIG. 6 is a transverse section view of the spinal board pad of FIG. 1, the section shown being at the level of a patient's head.

FIGS. 1, 2 and 5 illustrate straps 20 extending outward from side-slits 9, 9*a* of pad 2. Straps 20 encircle a patient and secure him or her to pad 2. Straps 20 are adjustable and terminate with plug 8*p* and socket 8*s*. Similarly, FIG. 6 shows headstraps 16 encircling a patient's head. Headstraps 16 diverge into arms 17*a* and 17*b* that secure the patient's head and chin respectively. The free ends of these straps 17*a* and 17*b* fasten to each other with Velcro so no objects are protruding onto a patient's forehead.

Figure 3:
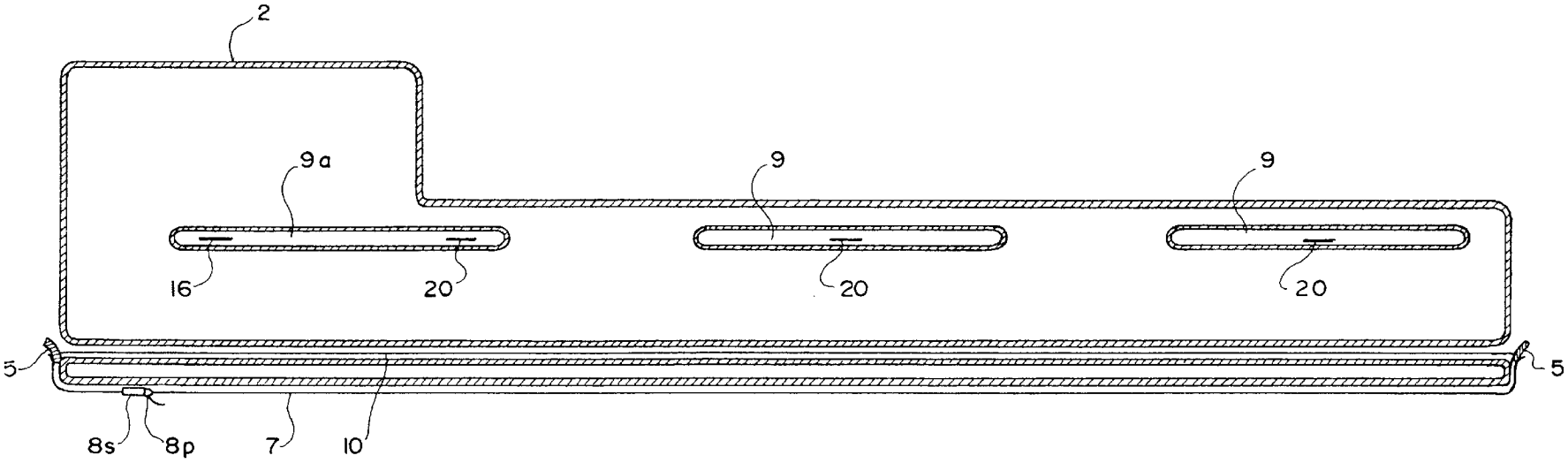
FIG. 3 is a longitudinal sectional view of the spinal board pad of FIG. 1, showing the spinal board pad on top of a long spinal board.
Figure 4:
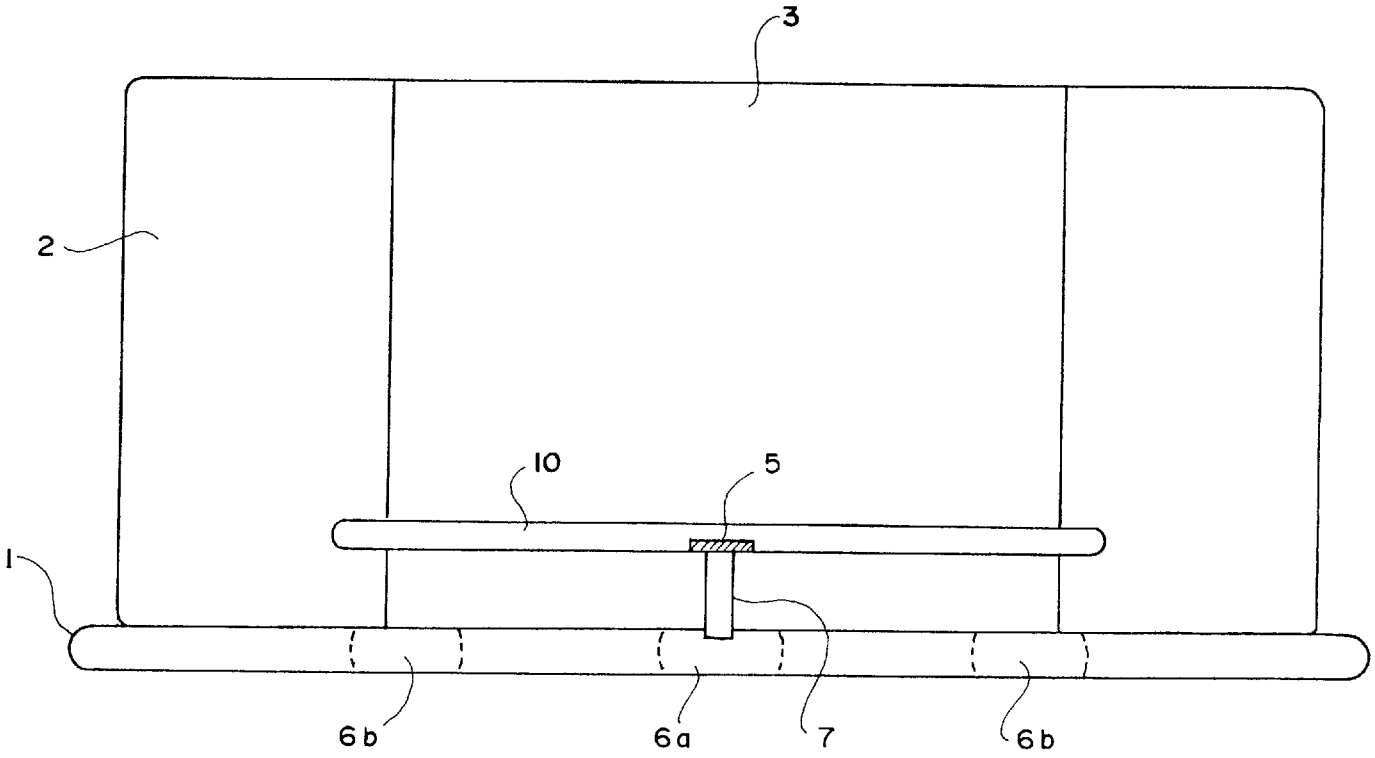
FIG. 4 is an end view of the spinal board pad shown in FIG. 1, showing the spinal board pad shown secured to a long spinal board.

In FIGS. 2 and 3, side-slits 9 and 9*a* extend from one side 24 of spinal pad 2 to the other side 24*a*. Side-slits 9 and 9*a* are wide enough to allow generous movement of straps 20 and headstrap 16. This will accommodate a variety of positions of spinal board side handhold 4 as well as a variety of patient shapes and sizes. FIGS. 1 and 3 depict additional strap 7 that extends longitudinally through pad 2 from an end 23 of board 1 to the other end 23*a*. Strap 7 secures pad 2 to board 1. As shown in FIG. 4, shows longitudinal slit 10 through which strap 7 travels is wide enough to allow strap 7 to move from side to side. Hence the straps can run through handholds 6*a* and 6*b* that might be at a variety of locations at ends 23 and 23*a* of board 1.

FIGS. 3 and 5 illustrate that longitudinal slit 10 preferably lies below and separated by foam core 12 from side slits 9 and 9*a*.

As shown in FIGS. 1, 2, 4, 5 and 6, straps 7, 20 and 16 have detachable stays 5 at the sites where they exit from end-slits 10 and side-slits 9 and 9*a*, respectively. Stays 5 prevent straps 7, 16 and 20 from falling out of pad 2. Just lateral to stays 5, straps 20, 20*a* and 16 have branching straps 14, 14*a* and 16*a* respectively, which go through spinal board side handholds 4. Straps 20 and 16 then ascend to attach to additional straps 25 and 26, respectively, in an adjustable fashion with plug and socket fasteners 8*p* and 8*s*, respectively. This secures pad 2 to board 1.

The above description is the inventor's preferred embodiment. However, those of ordinarily skill in the art to which the invention pertains will be aware of variations and modifications that do not depart from the scope of applicant's invention as hereinafter claimed.

I claim:

1. A spinal pad apparatus, comprising:

(1) contoured spinal padding having a width less than a minimum distance between sideholds of an associated spinal board, having a length such that the end handholds of the associated spinal board are not covered by the spinal padding;

(2) additional padding at the area of the patient's head that would place the patient's neck in an anatomically neutral position, when the patient is placed on the spinal board;

(3) the spinal padding and the additional padding being tapered when viewed from above so as to follow the contour of any associated spinal board which may be tapered;

(4) the additional padding being connected to the spinal padding either as one piece or as two separate pieces connected together, and wherein the additional padding does not extend into the area where the patient's neck would be so as to preclude proper application of cervical collar; and (5) the spinal padding further having side-slits that extend from side to side and are wide enough to allow generous longitudinal movement of straps within these side-slits.

2. The apparatus according to claim 1, the spinal and head padding further having at least one slit extending from end to end, the at least one slit being wide enough to allow generous transverse movement of a strap within the end-slit to allow the strap to accommodate a variety of handhold positions.

3. The apparatus according to claim 2, having the end-slit below and separated from the side-slits by a portion of the foam core.

4. A spinal pad apparatus, comprising (1) contoured spinal padding having a width less than the minimum distance between side handholds of an associated spinal board, wherein the length of the spinal padding is such that end handholds of the associated spinal board are not covered by the spinal padding; (2) head padding at the area of a patient's head that would place the patient's neck in an anatomically neutral position when a patient is placed on the spinal board; (3) the spinal padding and the head padding, when viewed from above, following the contour of any spinal board which may be tampered; (4) the head padding being connected to the spinal padding either as one piece or as two separate pieces connected together, and wherein the head padding does not extend into the area where the patient's neck would lie so as to preclude proper application of a cervical collar; (5) the spinal padding having at least one side-slit that extends from side to side and is wide enough to allow generous longitudinal movement of a strap within the at least one side-slit (6) the spinal and head padding having at least one end-slit extending from end to end, the at least one end-slit being wide enough to allow generous transverse movement of a strap within the end-slit to allow the strap to accommodate a variety of handhold positions, and the at least one end-slit being below and separated from the at least one side-slit by a portion of foam core of the spinal padding; and (7) a strap extending through each side-slit and branching into a Y-shape at each end of the strap after each end exits a respective side of a side slit, thereby allowing for one arm of the Y to meet an identical arm from the opposite side after the two arms encircle a patient to form a closed loop.

5. The apparatus according to claim 4, having the lower arm of the Y strap descending through the side handholds of the spinal board and ascending to adjustably attach to an additional strap by means of a plug and socket fastener, thereby forming a closed loop that secures the pad to the board.

6. The apparatus according to claim 5, having a strap running longitudinally through the end to end slit.

7. The apparatus according to claim 6, wherein the longitudinal strap descends through the end handholds of the spinal board and extends longitudinally along the lower surface of the board to adjoin the opposite end of the longitudinal strap by means of a plug and socket fastener, thus forming a closed loop.

8. The apparatus according to claim 7, wherein the most cephalad of each of the side straps branches into a Y type configuration, one arm of one Y being fastened over the patient's forehead to one arm of another Y from the opposite side of the spinal board, over the patient's forehead. The other arm of one Y being fastened over the patient's chin, to the other arm of the other Y, thus forming a closed loop.

9. The apparatus according to claim 8, having an additional strap adjoined to the headstrap where it exits the spinal pad, the additional strap descending through a spinal board side handhold and than ascending and adjustably fastening to itself thereby securing the pad to the board.

10. The apparatus according to claim 9, having detachable stays attached to the straps at all sites of exit from the pad.

11. The apparatus according to claim 10, wherein the core of the spinal pad is constructed of polyurethane and covered with polyvinyl chloride, including those surfaces exposed as a result of the formation of side-slits and end-slits.

* * * * *